United States Patent [19]

Potyka

[11] Patent Number: 4,616,115

[45] Date of Patent: Oct. 7, 1986

[54] COORDINATE SWITCH

[75] Inventor: Dieter Potyka, Hamburg, Fed. Rep. of Germany

[73] Assignee: U.S. Philips Corporation, New York, N.Y.

[21] Appl. No.: 641,530

[22] Filed: Aug. 16, 1984

[30] Foreign Application Priority Data

Aug. 17, 1983 [DE] Fed. Rep. of Germany ..... 3329673

[51] Int. Cl.[4] ..... H01H 3/46

[52] U.S. Cl. ..... 200/153 T; 200/6 A; 200/153 K; 273/148 B

[58] Field of Search ..... 200/153 T, 153 K, 6 A; 273/148 B

[56] References Cited

U.S. PATENT DOCUMENTS

| | | | |
|---|---|---|---|
| 2,984,720 | 5/1961 | Fisher | 200/153 T |
| 3,115,555 | 12/1963 | Lescarboura | 200/153 T |
| 3,385,942 | 5/1968 | McCann | 200/153 T |
| 4,273,972 | 6/1981 | Butterworth | 200/153 T |

FOREIGN PATENT DOCUMENTS

| | | | |
|---|---|---|---|
| 1227113 | 10/1966 | Fed. Rep. of Germany | 200/6 A |
| 1237892 | 6/1961 | France | 200/153 K |
| 426690 | 11/1947 | Italy | 200/153 K |

*Primary Examiner*—Stephen Marcus
*Assistant Examiner*—Renee S. Luebke
*Attorney, Agent, or Firm*—David R. Treacy

[57] ABSTRACT

The invention relates to a switching device (coordinate switch), in which four switches are actuated by displacement of an actuation member in two orthogonal directions and a fifth switch is actuated by displacement in a direction at right angles thereto.

6 Claims, 2 Drawing Figures

COORDINATE SWITCH

BACKGROUND OF THE INVENTION

The invention relates to a switching device comprising an actuation member, upon whose lateral displacement at least one of several switches can be actuated and which acts upon a further switch via a ram when depressed against the force of a spring.

Such switching devices may be utilized, for example, for controlling driving motors for a table plate in an X-ray examination apparatus, in which event efficaciously the direction of actuation and the direction in which the table plate is displaced by actuation of the switching device coincide. By the actuation of the further switch, a further function can be switched, which is independent of the displacement of the table plate.

In a known switching device of the kind mentioned in the opening paragraph (used in an X-ray apparatus named "Scopomat 73" marketed by N. V. Philips' Gloeilampenfabrieken), four microswitches are arranged around the ram in a manner such that their sides provided with a switching member face the cylindrical ram, which urges against one of the switching members upon a lateral displacement of the actuation member. The volume of such a switching device can be reduced, it is true, in that the microswitches are arranged as close as possible around the switching ram, but a small displacement of the actuation member is then already sufficient to initiate a switching process. Often however, short switching paths are unfavorably for the user. In a X-ray examination apparatus, for example, in which the user generally wears lead rubber gloves and acts by his thumb upon the actuation member, the user loses, with such short switching paths, the feeling whether the switch is actuated or is not actuated. A further disadvantage is that the forces which are exerted by the user on the actuation member have to be absorbed entirely by the switches.

SUMMARY OF THE INVENTION

The invention has for its object to construct a switching device of the kind mentioned in the opening paragraph in a manner such that sufficiently long switching paths are obtained in spite of a small constructional volume being available. According to the invention, this object is achieved in that the switches have sides provided with switching members, the switches being arranged such that the sides are located in a first plane, in that the switching members are further arranged around a switching disk displaceable in said first plane, and in that the switching disk is arranged so as to be displaceable on the switching ram, so that lateral displacement of the actuation member can activate at least one switch.

According to a preferred embodiment of the invention, the switching ram is bipartite, one ram portion (part) cooperating with the switching disk and being rigidly connected to the actuation member, the other ram portion (part) being arranged for acting upon the further switch and being displaceable perpendicular to the first plane, and that the two ram portions (parts) are relatively offset in an axial direction and are pressed against each other by means of a tensile spring with their surfaces facing each other.

According to the invention, the switching members are consequently actuated in that the switching disk overtravels them. The forces exerted by the user on the actuation member are not transmitted to the individual switches. The further switch is actuated in that the actuation member is displaced at right angles to the first plane, the first ram portion acting upon the second ram portion, which is guided in this direction and actuates the switching member of the further switch. If, on the contrary, the actuation member is laterally displaced, the first ram portion is tilted with respect to the second ram portion, the latter not being moved, the switching disk being displaced, however, until it actuates at least one switching member. The actuation member is reset by means of the pre-stressed tensile spring. When this tensile spring is suitably constructed, the tensile force exerted by it is only slightly increased upon lateral displacement of the actuation member so that the (resetting) force counteracting the actuation force of the user remains substantially constant upon displacement. The ease of operation is considerably improved thereby.

BRIEF DESCRIPTION OF THE DRAWING

In order that the invention may be readily carried out, it will now be described more fully with reference to the accompanying drawing, in which.

DESCRIPTION OF THE PREFERRED EMBODIMENT

Figure 1:
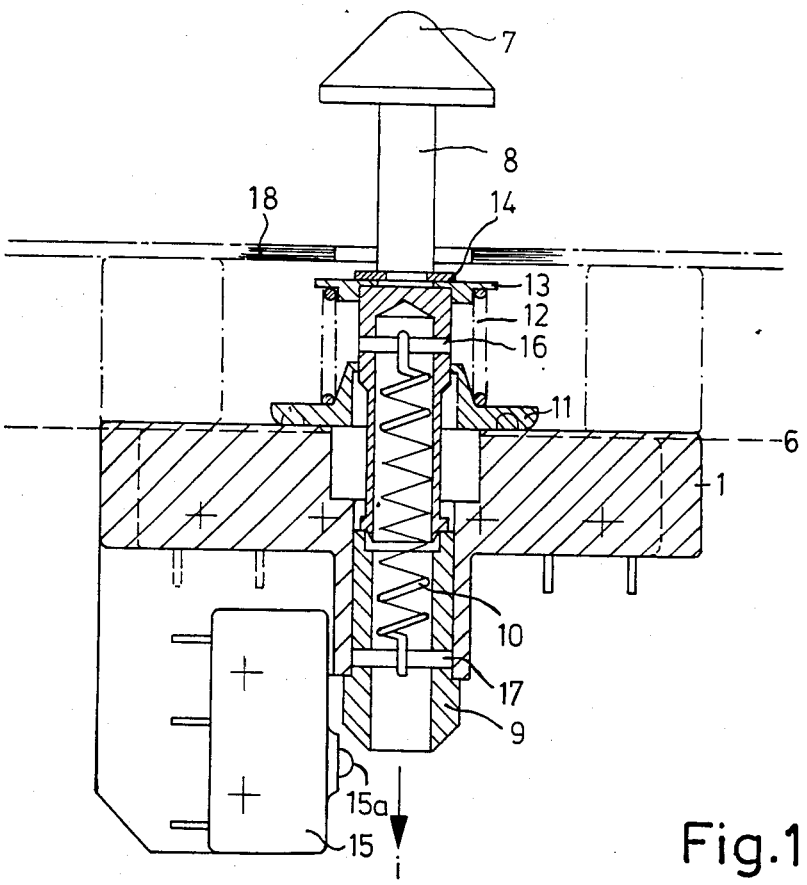
FIG. 1 is a sectional view of a switching device according to the invention.

The switching device shown in the drawing—a so-called coordinate switch—has a mounting and guiding body 1 to which five microswitches are secured. Four of these microswitches 2, 3, 4, 5 are arranged so that their switching members *2a, 3a, 4a, 5a* are located on the corners of a square and their sides provided with the switching members form a first plane which extends in FIG. 2 parallel to the plane of the drawing and in FIG. 1 at right angles to the plane of the drawing, the horizontally extending line of intersection with the plane of the drawing being designated by reference numeral 6 in FIG. 1.

The button-shaped actuation member 7 and the switching ram 8, 9 are situated midway between these four switches. The switching ram extends vertically in FIG. 1 and extends in FIG. 2 at right angles to the plane of the drawing, and is composed of two rotation-symmetrical parts 8, 9 which are arranged one behind the other in an axial direction. The ram portion 8 connected to the actuation member 7 has a cylindrical stem portion to the upper end of which is secured the actuation button 7 and whose lower end merges into a part in the form of a hollow cylinder, which is open on the lower side. The second ram portion 9 is passed in a vertical direction in a vertically extending bore in the mounting and guiding body 1 and has, at its lower end, an enlarged outer diameter which exceeds the inner diameter of the bore. This second portion is hollow. The two ram portions 8 and 9 are pressed against each other by a prestressed spring 10 which is secured to the ram portions 8 and 9 by means of pins 16 and 17 so that a lower end face of the ram portion 8 presses against an upper end face of the ram portion 9.

The ram portion 8 is enclosed by an annular switching disk 11 in a manner such that the switching disk and the switching ram portion are displaceable in a vertical direction with respect to each other (FIG. 1), but that they are moved towards each other upon a displacement in a horizontal direction. The outer diameter of the switching disk 11 is slightly smaller than the diagonal of the quadrangle formed by the switching members 2*a* . . . 5*a* so that the switching disk is arranged in a rest position midway between the switching members. The outer edge of the switching disk 11 is rounded on its lower side. The switching disk 11 is displaceable in the first plane 6 and on the upper side of the mounting and guiding body 1, respectively, which extends parallel to the plane 6 and slightly above this plane.

A spring 12 is arranged between the switching disk 11 and a plate 13 provided above it, which is fixed in the vertical direction by a ring 14. The spring is prestressed so that the disk 11 is pressed downwards. The pre-stress of this spring 12 is smaller, however, than that of the spring 10.

Below the four switches 2 . . . 5 is secured a fifth switch 15 to the mounting and guiding body 1 in a manner such that, upon a displacement of the ram portion 9 in a downward direction, its switching member 15*a* is actuated.

When the user presses the actuation member downwards, i.e. at right angles to the plane in which the switching disk 11 is displaceable, the ram portion 8 is displaced downwards against the force of the spring 12 together with the lower ram portion 9, until the outer surfaces of the latter actuate the switching member 15*a*. The ram portion 8 is then passed through the switching disk 11. The two ram portions 8 and 9 do not change their relative positions. The spring 12 resets the coordinate switch to its rest position when the user releases the actuation member 7.

When the user displaces the actuation member laterally, i.e. at right angles to the axis of the switching ram 8, 9, the ram portion 9 is not displaced, whereas the ram portion 8 is tilted so that its lower end face touches only at one point the end face of the lower ram portion facing it. The switching disk 11 does not follow the tilting movement of this ram portion because its inner diameter is slightly larger than the outer diameter of the ram portion 8 at the relevant point and because the spring 12 presses it with its lower side against the sides provided with switching members of the microswitches 2 . . . 5 and against the surface of the guiding body 1 parallel thereto, respectively. However, disk 11 is displaced laterally, while, depending upon the direction of the force exerted on the actuation member 7, a switching member is overtraveled (directions a . . . d in FIG. 2) or two switching members are overtravelled (directions e . . . h), as a result of which, as the case may be, further switching functions are performed. The force with which there is acted upon the switches and their switching members, respectively, is independent of the force applied by the user and corresponds to the pre-stress of the spring 12. Since the ram portion 8 is tilted and since the switching members 2*a* . . . 5*a* can be overtravelled by the switching disk without the use of further means, switching paths are obtained that can be felt, which is advantageous for the user.

When the ram portion 8 is tilted, the tension spring 10 is slightly expanded, which slightly increases the prestress. However, since this increase is considerably smaller than the pre-stress itself, the force to be applied by the user to the actuation member 7 for tilting the ram portion 8 remains substantially constant, which also contributes to the ease of operation. The resetting to the rest position after the release of the actuation member 7 is caused mainly by the spring 10 which contracts until the end faces of the ram portions 8 and 9 facing each other touch each other completely again.

A simple combination of several coordinate switches according to the invention can be obtained by lengthening the mounting and guiding body 1, in which event the coordinate switches are to be relatively offset in the longitudinal direction of this body.

Figure 2:
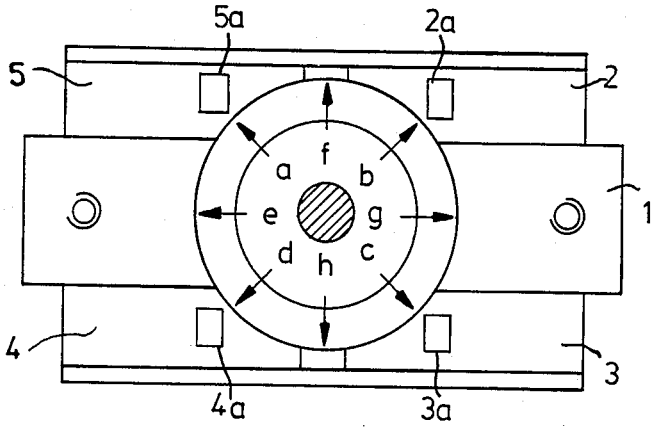
FIG. 2 is a plan view of such a switching device.

It is not desirable for every case of application that upon displacement of the actuation member two switches, for example the switches 2*a* and 5*a*, are actuated simultaneously. This can be avoided in that a switching guide 18 indicated by broken lines in FIG. 1 is arranged parallel to the plane 6 and above this plane, which switching guide 18 has recesses which extend solely in the direction of the arrows a, b, c and d and in which the stem of the ram portion 8 is passed upon displacement of the actuation member 7.

What is claimed is:

1. A coordinate switch comprising an actuation member fixed to an elongate switching ram, a mounting and guiding body having a bore therethrough, at least four electrical switches, each having a side provided with a switching member, the switches being fixed to the mounting and guiding body, the switches being arranged such that the sides are located in a first plane and such that the switching members are located at the corners of a quadrangle which lies in a second plane parallel to the first plane, a further switch axially displaced from said second plane, and a switching disk including a central opening therethrough, the central opening communicating with the bore of the mounting and guiding body, the switching disk being movable in the second plane and having a diameter which is slightly smaller than a diagonal of the quadrangle, the switching ram being bi-partite, comprising first and second ram portions axially offset from each other and a tension spring urging said portions against each other, said first ram portion cooperating with said switching disk and being fixed to said actuation member and being tiltable relative to the second ram portion, said first ram portion being axially movable for displacing said second ram portion axially, said ram being slidably disposed through the central opening and the bore so that a lateral displacement of the actuation member moves the switching disk into contact with at least one of said switching members, and axial displacement of the actuation member actuates said further switch.

2. A switching device as claimed in claim 1, characterized in that the two ram portions are hollow and in that the tension spring is situated in the interior of the two ram portions and is engaged to said portions urging them toward each other.

3. A coordinate switch as claimed in claim 1, wherein the quadrangle is a square.

4. A coordinate switch comprising an actuation member fixed to an elongate switching ram, a mounting and guiding body having a bore therethrough, at least four electrical switches, each switch having a side provided with a switching member, the switches being fixed to the mounting and guiding body, the switches being arranged such that the sides are located in a first plane and such that the switching members are located at the corners of a quadrangle which lies in a second plane parallel to the first plane, a switching disk including a central opening therethrough, the central opening communicating with the bore of the mounting and guiding body, the switching disk being movable in the second plane and having a diameter which is slightly smaller than a diagonal of the quadrangle, the switching ram being slidably disposed through the central opening and the bore, so that a lateral displacement of the actuation member moves the switching disk into contact with a switching member, and a compression spring situated between said disk and said actuating member, said compression spring being biased to urge said disk toward said second plane for engagement with said switches.

5. A coordinate switch comprising an actuation member fixed to an elongate switching ram, a mounting and guiding body having a bore therethrough, at least four electrical switches, each switch having a side provided with a switching member, the switches being fixed to the mounting and guiding body, the switches being arranged such that the sides are located in a plane and such that the switching members are located at the corners of a quadrangle, a further switch axially displaced from said plane, and a switching disk including a central opening therethrough, the central opening communicating with the bore of the mounting and guiding body, the switching disk being movable in said plane and having an outer diameter which is slightly smaller than a diagonal of the quadrangle, the switching ram comprising joined first and second tubular ram portions which are axially offset and extend generally perpendicular to said plane, the first ram portion being fixed to said actuation member and being pivotable relative to the second ram portion, said first and second ram portions having an initial unpivoted position of coaxial alignment in which said switches are unactuated, said ram further comprising a tension spring connected between said ram portions and biased for urging them toward each other in said unpivoted coaxial alignment and thus urging them toward said initial position, the first ram portion also being axially movable for displacing the second ram portion axially, said ram being slidably disposed through the central opening and the bore so that a pivotable displacement of the actuation member and first ram portion displaces the switching disk into contact with at least one of said switching members, and axial displacement of the actuation member and ram actuates said further switch.

6. A device according to claim 5 wherein said actuating member has a respective initial position corresponding to the initial position of said first and second ram portions in which said switches are unactuated, and said device further comprises a compression spring connected between said disk and said actuating member for urging said actuating member to said initial position.

* * * * *